US006028504A

United States Patent [19]

Segan

[11] Patent Number: 6,028,504

[45] **Date of Patent: *Feb. 22, 2000**

[54] REMOVABLE DOOR CHIME

[75] Inventor: Marc H. Segan, New York, N.Y.

[73] Assignee: M. H. Segan Limited Partnership, Great Barrington, Mass.

[ * ] Notice: This patent is subject to a terminal disclaimer.

[21] Appl. No.: 09/281,661

[22] Filed: Mar. 30, 1999

Related U.S. Application Data

[63] Continuation of application No. 09/156,192, Sep. 17, 1998, Pat. No. 5,914,650, which is a continuation of application No. 08/723,213, Sep. 27, 1996, Pat. No. 5,900,802.

[51] Int. Cl.[7] ..... G08B 3/00

[52] U.S. Cl. ..... 340/328; 340/326; 340/692; 340/392.1; 340/393.3; 340/384.1; 116/153

[58] Field of Search ..... 340/328, 330, 340/326, 692, 393.3, 327.2, 329, 384.1, 825.31, 825.32; 369/22; 116/9, 10, 153

[56] References Cited

U.S. PATENT DOCUMENTS

| | | | |
|---|---|---|---|
| 3,038,440 | 6/1962 | McEvoy | 116/141 |
| 3,938,120 | 2/1976 | O'Connell | 340/274 |
| 4,100,581 | 7/1978 | Sladk et al. | 360/12 |
| 5,309,510 | 5/1994 | Berndt | 379/167 |
| 5,365,214 | 11/1994 | Angott et al. | 340/328 |
| 5,463,371 | 10/1995 | Fuller | 340/426 |
| 5,570,083 | 10/1996 | Johnson | 340/692 |

*Primary Examiner*—Daryl Pope
*Attorney, Agent, or Firm*—Cohen, Pontani, Lieberman & Pavane

[57] ABSTRACT

The present invention provides a decorative door chime particularly well suited to festive occasions. The chime includes a speaker which is suspended on one side of the door by a strap, and a door-knocker actuated trigger switch suspended on the other side of the door by the strap. The strap encloses the electrical connections between the speaker and the trigger. The sound generator plays songs, tone sequences, recorded voice messages, etc., in response to actuation of the trigger switch.

16 Claims, 4 Drawing Sheets

REMOVABLE DOOR CHIME

RELATED APPLICATIONS

This application is a continuation of U.S. patent application Ser. No. 09/156,192 (filed Sep. 17, 1998) U.S. Pat. No. 5,914,650 which is a continuation of U.S. patent application Ser. No. 08/723,213 (filed Sep. 27, 1996) U.S. Pat. No. 5,900,802.

BACKGROUND OF THE INVENTION

I. Field of the Invention

The invention is related to annunciator devices. More particularly, the invention is directed to portable annunciator devices.

II. Description of the Related Art

Conventional door chimes, buzzers and similar visitor annunciators that summon occupants to the door of a given room or building conventionally have an actuator button mounted in a hole drilled in the exterior frame of the door. Radio-frequency signals, or wires running behind interior walls of the room then connect the button in the door frame to a chime installed inside the building, distant from the door. Alternatively, a hole will be drilled through the door itself, so that both the button and the chime are permanently mounted on the door. The actuator button on the outside of the door can then be directly connected to the chime, either electrically or mechanically.

Annunciator devices having both the chime and the actuator secured to the same side of the door using spring clamps or a permanently-mounted bracket are also known. However, in these devices, the chime or buzzer is on the wrong side of the door. When the actuator button and the sound generator are on the same side of the door, the sound cannot be clearly heard inside the room or building unless the door is already open. These single-unit chimes are generally used in shops to actuate a sound generator whenever the exterior door to the shop opens. They announce visitors when the door is already unlocked, in circumstances where visitors need not summon someone inside to open the door for them, whether the door is the exterior door of a shop or an interior door, such as the door to a child's room.

SUMMARY OF THE INVENTION

The present invention provides portable annunciator apparatus having a strap adapted to extend across the top of a door from a first end of a first portion of the strap on one side of the door to a second end of a second portion of the strap on the other side of the door. A sound generator is attached to the first portion of the strap and a sound actuator to the second portion of the strap.

A control connection between the sound actuator and sound generator is hidden by the strap. In a particular embodiment electrical conductors connecting the sound actuator to the sound generator are enclosed within the strap.

Preferably the sound actuator is a spring-mounted push button that is pressed by swinging a decorative door-knocker. When the door knocker strikes the push button, the push button momentarily toggles a switch from a resting position in which the sound-generator circuit is open, to a closed position in which the sound generator circuit is activated.

Advantageously, the door chime can be temporarily installed on a door without damage to the door's surface. Thus, it provides non-destructive means for supporting seasonal decorations such as Christmas wreaths.

Also, in a particular embodiment, the sound generator stores and plays prerecorded sounds: songs, tone sequences, or recorded voice messages, and the strap is covered on all sides with a decorative material. This embodiment is particularly advantageous for use as a part of holiday or party decorations because it is easily installed and removed without the need for tools or skilled electrical or carpentry work and without defacing the door.

Alternatively, means for recording greetings, or other audio materials, for storage and reproduction by the sound generator may be provided.

BRIEF DESCRIPTION OF THE DRAWINGS

The features and advantages of the present invention will be better understood when the detailed description of preferred embodiments given below is considered in conjunction with the figures provided, wherein.

In these figures like structures are assigned like reference numerals.

DETAILED DESCRIPTION OF THE PRESENTLY PREFERRED EMBODIMENTS

Figure 1:
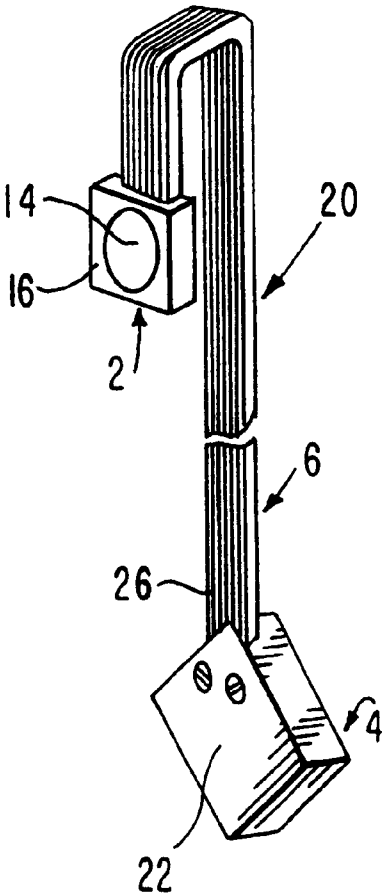
FIG. 1 is a perspective view of a first embodiment of the present invention showing the front of the first enclosure.
Figure 2A:
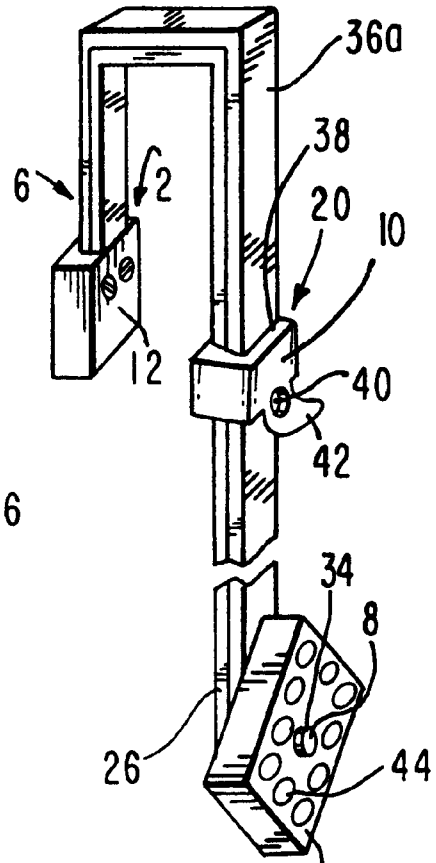
FIG. 2*a* is a perspective view of a second embodiment of the invention, showing the front of the second enclosure.
Figure 2B:
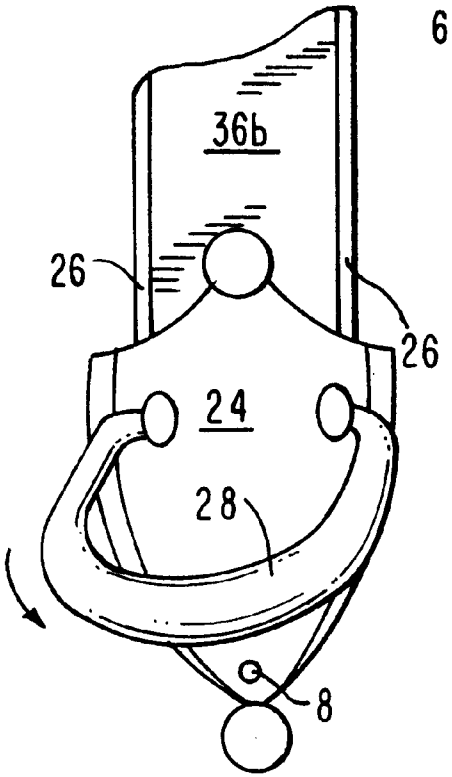
FIG. 2*b* is a plan view of a preferred embodiment of the front of the second enclosure.
Figure 3:
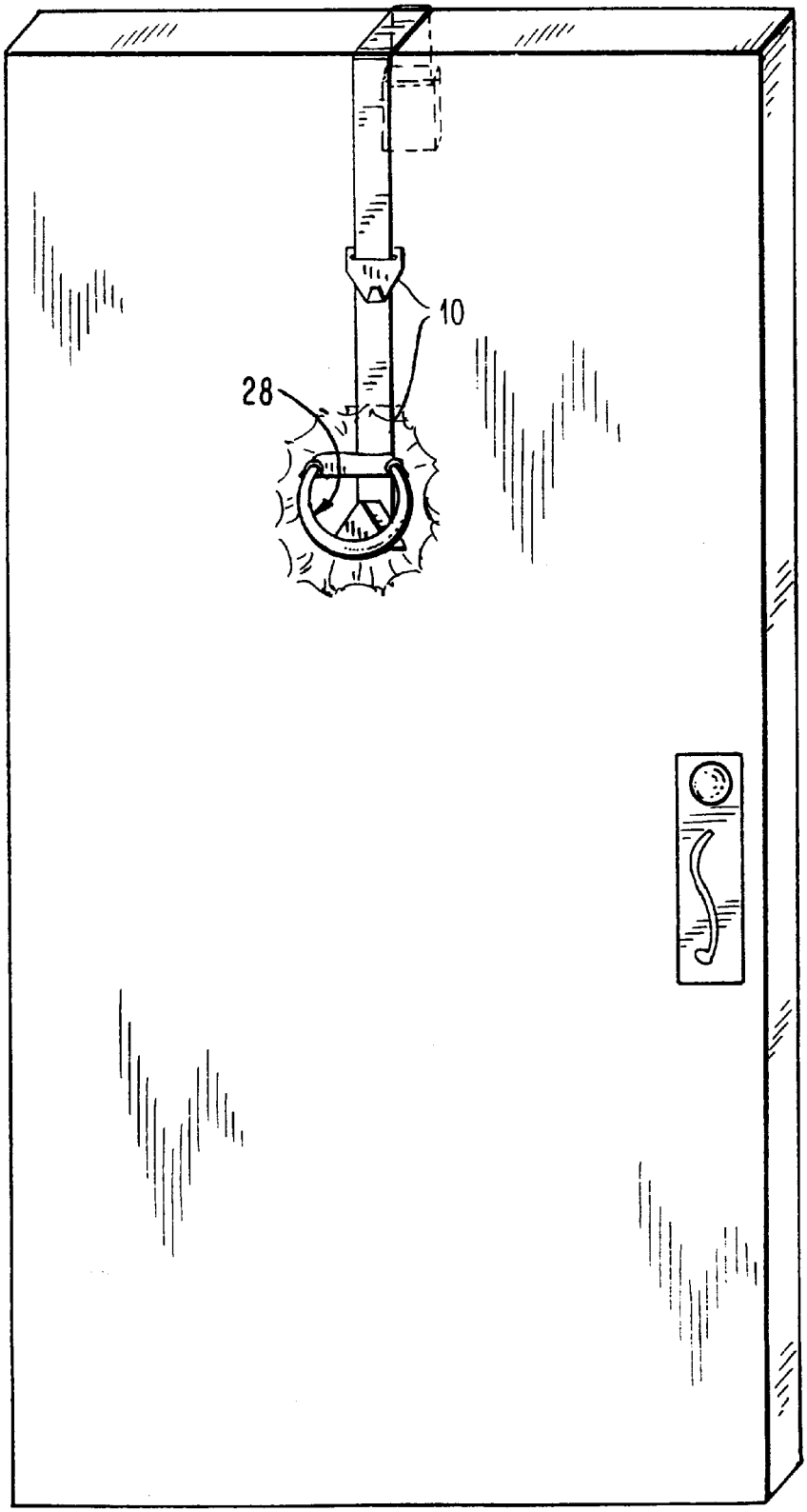
FIG. 3 is a perspective view of the door chime device of FIG. 1 mounted on a door.
Figure 4:
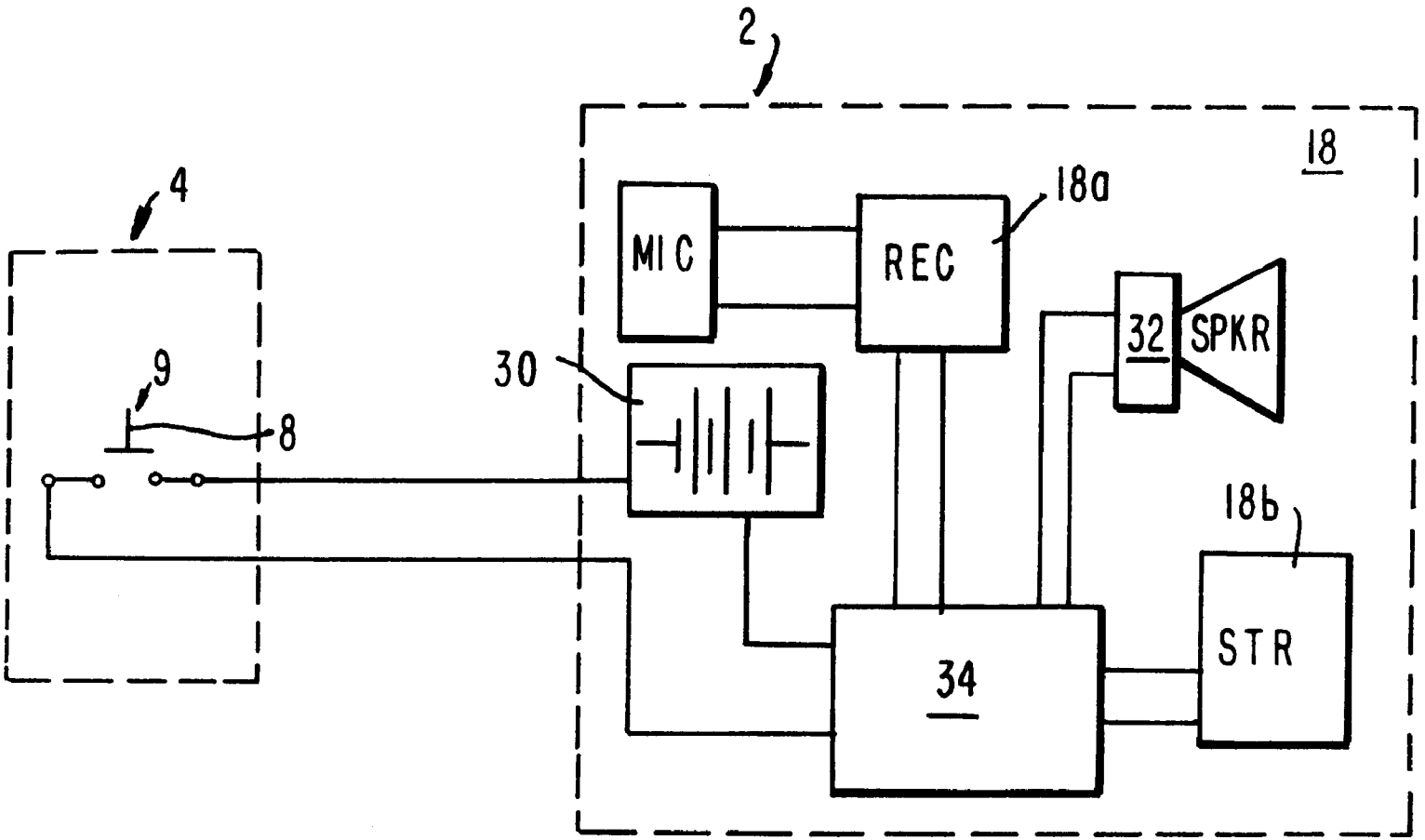
FIG. 4 is a block diagram of an embodiment of the present invention.

Referring now to the drawings, a door chime 20 constructed in accordance with the present invention provides first and second enclosures 2, 4 at opposite ends of a strap 6, as shown in FIGS. 1–3 configured for respective placement near an inside and an outside surface of a door. A push-button actuator 8 protrudes from the second enclosure 4 that can be used to actuate a switch 9 (FIG. 4). Preferably the first enclosure 2 is rectangular and has a rear wall 12 adapted to rest against the inside surface of a door and plurality of sound apertures 14 in a front wall 16. A sound generating circuit 18 shown in FIGS. 4 and 5, is preferably provided in the first enclosure 2.

The second enclosure 4 has a rear wall 22 adapted to rest against the door and a front wall 24 including an aperture 34 through which the push button 8 protrudes. Preferably the switch 9 is a spring-loaded, momentarily-closed switch that is actuated when the push button actuator 8 is struck by a door-knocker 28 that moves the switch 9 from its initially-open, resting position, to an active, closed position that completes the sound generating and emitting circuit 18 shown in FIG. 5, triggering the sound generator 18. Obviously, in a different sound generator circuit the push button may be initially closed and toggle to an open position when struck by the door-knocker 28.

Figure 5:
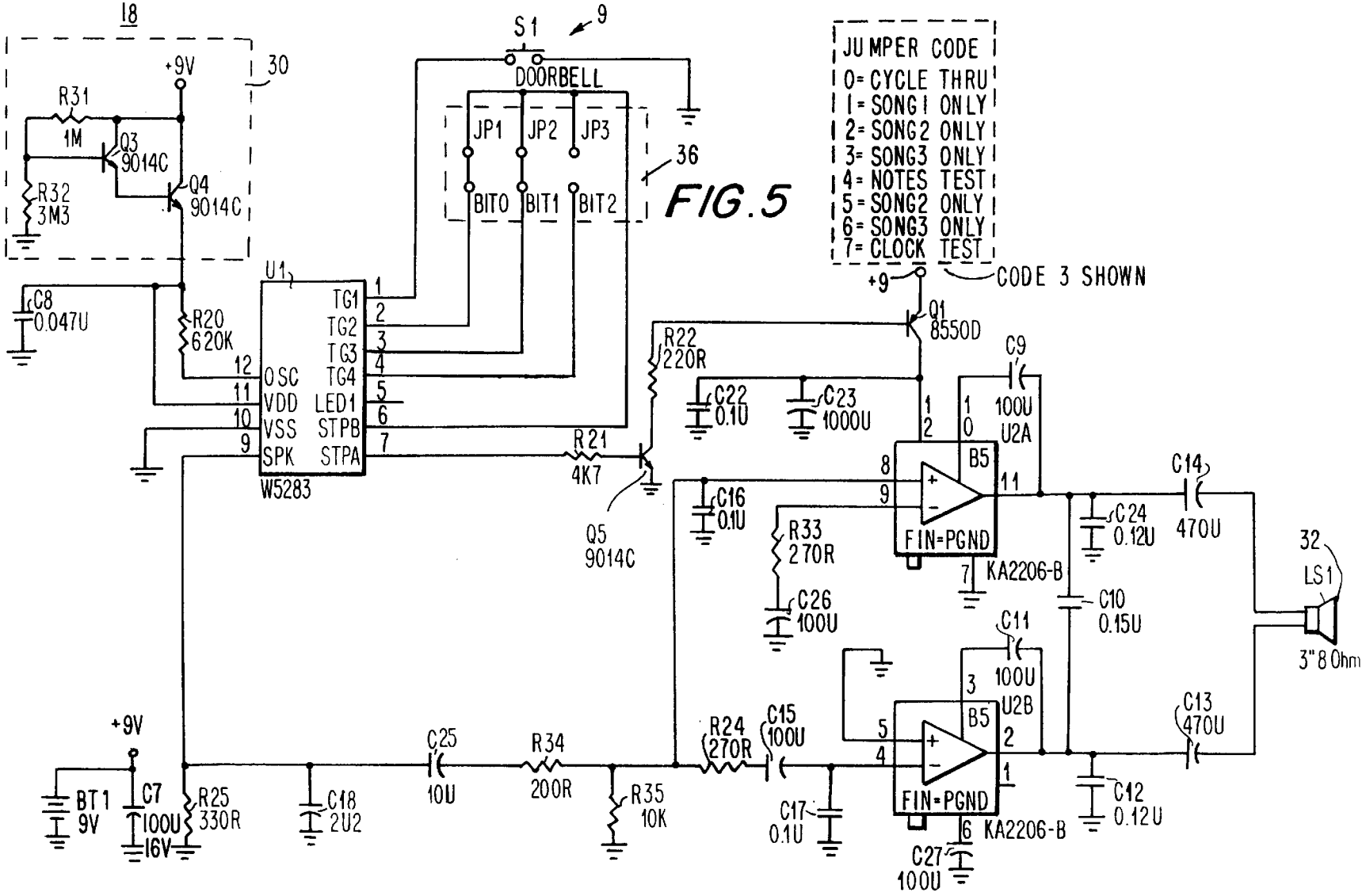
FIG. 5 is an circuit diagram of a sound generator circuit for a preferred embodiment of the present invention.

FIG. 5 is a circuit diagram of a suitable sound generating and emitting circuit 18 that uses prerecorded sound information. The sound generating circuit 18 includes means 34 for storing and playing one or more prerecorded song, tone sequence or spoken message and drives a speaker 32. In the preferred embodiment, three prerecorded songs are digitally stored in the sound generating circuit 18, although a greater or lesser number may be included. Alternatively, some or all of the songs, tones, or spoken messages may be recorded and stored by the user. The sound generating circuit 18 may comprise any suitable known digital or analog music, tone, or voice recording 18*a* and storage 18*b* means as indicated in FIG. 4. As circuits of this type are known in the art, further description is deemed unnecessary.

A power supply section 30 provides power for the sound generating circuit 18. In the preferred embodiment, the power supply section 30 is a replaceable battery, contained within the first enclosure 2, that supplies power when the push button 8 triggers the operation of the sound emitting and generating circuit 18. The sound emitting and generating circuit 18 and sound storage unit 18*b* may be housed in either the first enclosure 2 or the second enclosure 4. However, a speaker 32 must be located on the inside of the door, in the first enclosure 2 and the switch 8 must be located on the outside of the door, in the second enclosure 4, to assure effective communication by the visitor outside with the person on the inside who must open the door. However, a supplementary speaker (not shown) in the enclosure 4 located on the outside of the door may provide a greeting or musical entertainment for the visitor.

The strap 6 is preferably made of galvanized sheet steel, covered with a decorative ribbon 36*a,* and connected with a plurality of screws to the inside of the respective enclosures 2, 4. The electrical conductors 26 connecting the circuit elements in the first and second enclosures 2, 4 are preferably incorporated inside a decorative whipped-stitch edging on a plush ribbon sleeve 36*b* that covers the strap 6. Alternatively, the conductors 26 may be integral to the strap 6, when the strap is an electrical ribbon cable as shown in FIG. 1. Radio frequency signals could provide the necessary communication between the first and second enclosures 2, 4, but wire connections are more cost-effective, which is particularly important for season decorations and other occasional-use, special-purpose items. Since doors are generally a certain standard height and thickness, the length of the strap 6 is preferably fixed. In an alternative embodiment, the length of the strap 6 can be lengthened or shortened by suitable slidable suspender-type loops, to raise or lower the switch 8 and door-knocker 28 to a convenient level.

The holding clip 10 is preferably made of plastic and includes a hole 40 through which an ornament hook or other securing means for such decorations can be threaded. A plurality of slidable holding clips 10 may be employed.

Additionally, a plurality of lights 44 mounted on the second enclosure 4 may be steadily or randomly lighted, or sequentially lighted so as to appear to "chase" each other and provide an illusion of movement. The lights 44 may be connected to power supply and control circuitry in one of the enclosures 2, 4.

In operation, and as shown in FIG. 3 the user hangs the strap 6 over the top of the door to mount the door chime 20 on the door. The first enclosure 2 then abuts the inside surface of the door, i.e., the surface facing the person who unlocks the door, and the second enclosure 4 abuts the outside of the door so as to be accessible to visitors.

When the door-knocker 28 shown in FIG. 3 is swung and released it strikes the push button 8 closing a switch 9 that causes the electrical conductors 26 to supply a signal that activates the sound generator 18 in the first enclosure 2. In response, the sound emitting and generating circuit 18 in the first enclosure 2 plays one of a plurality of prerecorded songs stored in the storage device 18*b* through the speaker 32. Each time the door-knocker 28 is swung and released, the sound generating circuit 18 may play the next stored song in a preset sequence determined by their order of storage in the storage device 18*b* or one particular song may be enabled by a factory-set jumper-wire connection 36, as shown in FIG. 5. For example, the jumper 36 setting shown in FIG. 5 will play "SONG3" only.

The user removes the door chime 20 by simply lifting the strap 6 off the top of the door. The door chime 20 may then be moved to another door or stored. In the preferred embodiment, the knocker 28 of the door chime 20 is surrounded with a Christmas-season wreath and the sleeve 36*b* on the strap 6 is made of red velveteen ribbon. In alternative embodiments, other holiday decorations, e.g. New Year, July 4th, Halloween, birthday, etc., may be used, or a button or ornamental knocker 28 may be used without further decoration.

The invention has been described with reference to particular preferred embodiments thereof, but it will be obvious to one skilled in the art that variations and modifications are possible without departing from the spirit and scope of the invention. For example, the strap may, alternatively, be made of plastic. The invention is defined in the appended claims.

What is claimed is:

1. A removable annunciator apparatus releasably mountable on a door providing access to an interior location and having an outside surface, an inside surface and a top, said annunciator enabling a first person outside of the interior location to notify a second person in the interior location that the first person is proximate the outside surface of the door, said apparatus comprising:

a strap adapted to extend across the top of the door, said strap having a first portion terminating at a first end located on the inside surface of the door and a second portion terminating at a second end located on the outside surface of the door;

a sound emitter attached to said first portion of the strap on the inside surface of the door for emitting at least one pre-stored sound to the second person;

a generating means operably connected to said sound emitter for generating said at least one pre-stored sound for output through said sound emitter; and an actuating member located proximate said second end of said strap at a suitable height for providing ready access for selective operation by the first person, said actuating member being engageable for providing a signal to said generating means for broadcasting said at least one pre-stored sound from said sound emitter for notifying the second person in the interior location that the first person is proximate the outside surface of the door, said strap further comprising a plurality of electrical conductors for electrically connecting said generating means to one of said sound emitter and said actuating member.

2. The annunciator apparatus of claim 1, wherein said plurality of electrical conductors are hidden by said strap.

3. The annunciator apparatus of claim 1, wherein said plurality of electrical conductors are enclosed by said strap.

4. The annunciator apparatus of claim 1, wherein said actuating member comprises a graspable member for operating said generating means.

5. The annunciator apparatus of claim 4, wherein said graspable member comprises a door knocker.

6. The annunciator apparatus of claim 1, further comprising a switch disposed between said graspable member and said sound emitter and engageable by said graspable member for selectively providing electrical connection between said sound emitter and said generating means through said plurality of electrical conductors.

7. The annunciator apparatus of claim 1, wherein said strap is adjustable so as to permit selective movement of said second portion of said strap relative to the top of the door.

8. The annunciator apparatus of claim 1, wherein said plurality of electrical conductors are hidden by said strap.

9. The annunciator apparatus of claim 1, wherein said plurality of electrical conductors are enclosed by said strap.

10. The annunciator apparatus of claim 1, wherein said actuating member comprises a graspable member for operating said generating means.

11. The annunciator apparatus of claim 10, wherein said graspable member comprises a door knocker.

12. The annunciator apparatus of claim 1, further comprising a switch disposed between said graspable member and said sound emitter and engageable by said graspable member for selectively providing electrical connection between said sound emitter and said generating means through said plurality of electrical conductors.

13. The annunciator apparatus of claim 1, wherein said sound emitter comprises a speaker.

14. The annunciator apparatus of claim 1, wherein said generating means is positioned on the inside surface of the door and said electrical conductors connect said actuating member to said generating means.

15. The annunciator apparatus of claim 1, wherein said generating means is positioned on the outside surface of the door and said electrical conductors connect said actuating member to said sound emitter.

16. A method for providing communication from a first person positioned proximate an outside surface of a door, which provides access to an interior location, to a second person positioned in the interior location to alert the second person that the first person is proximate the outside surface of the door, said method comprising the steps of:

providing an annunciator device, said annunciator having;

a strap adapted to extend across the top of the door, said strap having a first portion terminating at a first end located on the inside surface of the door and a second portion terminating at a second end located on the outside surface of the door;

a sound emitter attached to said first portion of the strap on the inside surface of the door for emitting at least one pre-stored sound to the second person;

a generating means operably connected to said sound emitter for generating said at least one pre-stored sound for output through said sound emitter; and an actuating member located proximate said second end of said strap at a suitable height for providing ready access for selective operation by the first person, said actuating member being engageable for providing a signal to said generating means for broadcasting said one pre-stored sound from said sound emitter;

said strap further comprising a plurality of electrical conductors for electrically connecting said generator to one of said sound emitter and said actuating member;

removably disposing said strap across the top of the door so that said actuating member is positioned at the outside surface of the door and the sound emitter is positioned at the inside surface of the door; and activating said actuating member for providing said signal to said generating means for broadcasting one of said plurality of pre-stored sounds from said sound emitter for notifying the second person in the interior location that the first person is proximate the outside surface of the door.

* * * * *